US010119377B2

(12) United States Patent
Snider

(10) Patent No.: US 10,119,377 B2
(45) Date of Patent: Nov. 6, 2018

(54) SYSTEMS, ASSEMBLIES AND PROCESSES FOR CONTROLLING TOOLS IN A WELL BORE

(75) Inventor: Philip M. Snider, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 1665 days.

(21) Appl. No.: 12/102,687

(22) Filed: Apr. 14, 2008

(65) Prior Publication Data

US 2009/0223670 A1 Sep. 10, 2009

Related U.S. Application Data

(63) Continuation-in-part of application No. 12/044,087, filed on Mar. 7, 2008, now Pat. No. 9,194,227.

(51) Int. Cl.

| | |
|---|---|
| ***E21B 43/26*** | (2006.01) |
| ***E21B 23/00*** | (2006.01) |
| ***E21B 34/16*** | (2006.01) |
| ***E21B 43/14*** | (2006.01) |

(52) U.S. Cl.

CPC ..... *E21B 43/26* (2013.01); *E21B 23/00* (2013.01); *E21B 34/16* (2013.01); *E21B 43/14* (2013.01)

(58) Field of Classification Search

USPC ..... 166/373, 375, 318, 308.1

See application file for complete search history.

(56) References Cited

U.S. PATENT DOCUMENTS

| | | | |
|---|---|---|---|
| 3,684,008 | A | 8/1972 | Garrett |
| 3,706,094 | A | 12/1972 | Cole et al. |
| 4,023,167 | A | 5/1977 | Wahlstrom |
| 4,096,477 | A | 6/1978 | Epstein et al. |
| 4,119,146 | A | 10/1978 | Taylor |
| 4,166,215 | A | 8/1979 | Anderson |

(Continued)

FOREIGN PATENT DOCUMENTS

| | | | |
|---|---|---|---|
| EP | 0013494 | A1 | 7/1980 |
| EP | 0412535 | B1 | 2/1991 |

(Continued)

OTHER PUBLICATIONS

Den-Con Tool Co., General Catalog, 1994-95, pp. 1-3.

(Continued)

*Primary Examiner* — D. Andrews

(74) *Attorney, Agent, or Firm* — Blank Rome LLP

(57) ABSTRACT

A dedicated hydraulic line for transmission of a signal device capable of generating one or more unique signals to one or more tools within a subterranean well. Each tool can be equipped with a reader device for receiving signals from and transmitting signals to the signal device. Each reader device can control operation of the tool associated therewith if the reader device is programmed to respond to signals received from the signal device. Hydraulic fluid used to operate the tool can be conveyed via the dedicated hydraulic line or a separate hydraulic line. A separate hydraulic line can be used to reset the tool. Where the tools include sliding sleeves, the tools can be used to hydraulically fracture subterranean environs at spaced apart locations along a well bore in any desired sequence and without removing the tools from the well during the fracturing process.

28 Claims, 5 Drawing Sheets

(56) References Cited

U.S. PATENT DOCUMENTS 4,166,216 A 8/1979 Cubberly, Jr.
4,271,925 A 6/1981 Burg
4,535,430 A 8/1985 Cochrane et al.
4,572,293 A 2/1986 Wilson et al.
4,599,182 A 7/1986 Young et al.
4,622,463 A 11/1986 Hill
4,630,044 A 12/1986 Polzer
4,656,463 A 4/1987 Anders
4,656,944 A 4/1987 Gonzalez
4,698,631 A 10/1987 Kelly, Jr. et al.
4,808,925 A 2/1989 Baird
4,827,395 A 5/1989 Anders et al.
4,837,515 A 6/1989 Nishihara et al.
4,977,961 A * 12/1990 Avasthi ..... 166/297
5,029,644 A * 7/1991 Szarka et al. ..... 166/223
5,047,632 A 9/1991 Hunt
5,105,742 A 4/1992 Sumner
5,130,705 A 7/1992 Allen et al.
5,142,128 A 8/1992 Perkin et al.
5,160,925 A 11/1992 Dailey et al.
5,182,939 A 2/1993 Chien et al.
5,191,936 A 3/1993 Edwards et al.
5,202,680 A 4/1993 Savage
5,206,680 A 4/1993 Dillow
5,230,387 A 7/1993 Waters et al.
5,279,366 A 1/1994 Scholes
5,354,956 A 10/1994 Orban et al.
5,355,957 A 10/1994 Burleson et al.
5,361,838 A 11/1994 Kilgore
5,394,141 A 2/1995 Soulier
5,417,284 A 5/1995 Jones
5,457,447 A 10/1995 Ghaem et al.
5,467,083 A 11/1995 McDonald et al.
5,479,860 A 1/1996 Ellis
5,495,237 A 2/1996 Yuasa
5,497,140 A 3/1996 Tuttle
5,505,134 A 4/1996 Brooks et al.
5,530,358 A 6/1996 Wisler et al.
5,608,199 A 3/1997 Clouse, III et al.
5,621,647 A 4/1997 Kraemer et al.
5,626,192 A 5/1997 Connell et al.
5,629,623 A 5/1997 Sezginer et al.
5,654,693 A 8/1997 Concita
5,660,232 A 8/1997 Reinhardt
5,680,459 A 10/1997 Hook et al.
5,680,905 A 10/1997 Green et al.
5,682,099 A 10/1997 Thompson et al.
5,682,143 A 10/1997 Brady et al.
5,706,896 A 1/1998 Tubel et al.
5,720,345 A 2/1998 Price et al.
5,829,538 A 11/1998 Wesson et al.
5,836,406 A 11/1998 Schuh
5,864,323 A 1/1999 Berthon
5,877,996 A 3/1999 Krokstad et al.
5,911,277 A 6/1999 Hromas et al.
5,923,167 A 7/1999 Chang et al.
5,931,239 A 8/1999 Schuh
5,939,885 A 8/1999 McClure et al.
5,955,666 A 9/1999 Mullins
5,991,602 A 11/1999 Sturm
5,995,449 A 11/1999 Green et al.
6,018,501 A 1/2000 Smith et al.
6,025,780 A 2/2000 Bowers et al.
6,078,259 A 6/2000 Brady et al.
6,081,729 A 6/2000 Bauerschmidt et al.
6,085,805 A 7/2000 Bates
6,097,301 A 8/2000 Tuttle
6,105,688 A 8/2000 Vaynshteyn et al.
6,125,934 A 10/2000 Lenn et al.
6,130,602 A 10/2000 O'Toole et al.
6,135,206 A 10/2000 Gano et al.
6,151,961 A 11/2000 Huber et al.
6,158,532 A 12/2000 Logan et al.
6,176,318 B1 1/2001 Drakeley et al.
6,181,138 B1 1/2001 Hagiwara et al.
6,184,685 B1 2/2001 Paulk et al.
6,189,621 B1 2/2001 Vail, III
6,243,041 B1 6/2001 Mischenko et al.
6,249,258 B1 6/2001 Bloch et al.
6,253,842 B1 7/2001 Connell et al.
6,257,338 B1 7/2001 Kilgore
6,288,548 B1 9/2001 Thompson et al.
6,288,685 B1 9/2001 Thomas
6,324,904 B1 12/2001 Ishikawa et al.
6,333,699 B1 12/2001 Zierolf
6,333,700 B1 12/2001 Thomeer et al.
6,343,649 B1 2/2002 Beck et al.
6,359,569 B2 3/2002 Beck et al.
6,366,089 B1 4/2002 Poitzsch et al.
6,426,917 B1 7/2002 Tabanou et al.
6,429,653 B1 8/2002 Kruspe et al.
6,443,228 B1 * 9/2002 Aronstam et al. ..... 166/250.11
6,450,258 B2 9/2002 Green et al.
6,476,609 B1 11/2002 Bittar
6,481,505 B2 11/2002 Beck et al.
6,497,280 B2 12/2002 Beck et al.
6,515,919 B1 2/2003 Lee
6,531,871 B1 3/2003 Hay et al.
6,536,524 B1 3/2003 Snider
6,567,013 B1 5/2003 Purkis et al.
6,575,237 B2 6/2003 Purkis et al.
6,577,244 B1 6/2003 Clark et al.
6,588,505 B2 7/2003 Beck et al.
6,597,175 B1 7/2003 Brisco
6,614,229 B1 9/2003 Clark et al.
6,717,501 B2 4/2004 Hall et al.
6,759,968 B2 7/2004 Zierolf
6,761,219 B2 7/2004 Snider et al.
6,766,703 B1 7/2004 Kluth et al.
6,788,263 B2 9/2004 Clark et al.
6,822,579 B2 11/2004 Goswami et al.
6,915,848 B2 7/2005 Thomeer et al.
6,943,697 B2 9/2005 Ciglenec et al.
6,989,764 B2 1/2006 Thomeer et al.
7,014,100 B2 3/2006 Zierolf
7,063,148 B2 6/2006 Jabusch
7,159,654 B2 1/2007 Ellison et al.
7,268,688 B2 9/2007 Juds
7,283,061 B1 10/2007 Snider et al.
7,400,263 B2 7/2008 Snider et al.
7,677,439 B2 3/2010 Zierolf
7,714,741 B2 5/2010 Snider et al.
8,001,858 B2 8/2011 Cogen et al.
8,044,820 B2 10/2011 Snider et al.
8,091,775 B2 1/2012 Zierolf
2001/0013410 A1 8/2001 Beck et al.
2001/0013411 A1 8/2001 Beck et al.
2001/0042617 A1 11/2001 Beck et al.
2001/0043146 A1 11/2001 Beck et al.
2001/0054969 A1 12/2001 Thomeer et al.
2002/0007949 A1 1/2002 Tolman et al.
2002/0014966 A1 2/2002 Strassner et al.
2002/0093431 A1 7/2002 Zierolf
2002/0133942 A1 9/2002 Kenison et al.
2002/0158120 A1 10/2002 Zierolf
2003/0058125 A1 3/2003 Ciglenec et al.
2003/0090390 A1 5/2003 Snider et al.
2004/0211567 A1 10/2004 Aud
2004/0239521 A1 12/2004 Zierolf
2005/0115708 A1 6/2005 Jabusch
2005/0237200 A1 10/2005 Bellum et al.
2006/0175404 A1 8/2006 Zierolf
2006/0196667 A1 * 9/2006 Alba ..... E21B 33/128 166/308.1
2008/0271887 A1 11/2008 Snider et al.
2009/0223663 A1 9/2009 Snider et al.
2010/0013664 A1 1/2010 Zierolf
2010/0171593 A1 7/2010 Zierolf
2010/0193184 A1 8/2010 Dolman et al.
2010/0219980 A1 9/2010 Snider et al.

(56) References Cited

U.S. PATENT DOCUMENTS

| | | | |
|---|---|---|---|
| 2011/0252878 | A1 | 10/2011 | Snider |
| 2012/0298243 | A1 | 11/2012 | Zierolf |

FOREIGN PATENT DOCUMENTS

| | | | |
|---|---|---|---|
| EP | 0651132 | A2 | 5/1995 |
| EP | 0730083 | A2 | 9/1996 |
| EP | 1152262 | A1 | 11/2001 |
| FR | 1033631 | | 7/1953 |
| SU | 1657627 | | 6/1991 |
| WO | 2000/045195 | | 8/2000 |
| WO | 200118357 | A2 | 3/2001 |
| WO | 01/61144 | A1 | 8/2001 |
| WO | 200173423 | A1 | 10/2001 |
| WO | 2006/101618 | A2 | 9/2006 |
| WO | WO 2006/101618 | * | 9/2006 |
| WO | 2008/091345 | A1 | 7/2008 |
| WO | 2009114356 | A1 | 9/2009 |
| WO | 2011/130176 | A1 | 10/2011 |

OTHER PUBLICATIONS

U.S. Office Action from U.S. Appl. No. 10/887,366 dated Dec. 5, 2006.
U.S. Office Action from U.S. Appl. No. 10/887,366 dated May 17, 2007.
U.S. Office Action from U.S. Appl. No. 10/887,366 dated Aug. 21, 2007.
U.S. Office Action from U.S. Appl. No. 10/887,366 dated Nov. 23, 2007.
U.S. Office Action from U.S. Appl. No. 10/887,366 dated Jun. 18, 2008.
U.S. Office Action from U.S. Appl. No. 10/887,366 dated Nov. 10, 2008.
U.S. Office Action from U.S. Appl. No. 12/173,693 dated Feb. 25, 2009.
U.S. Office Action from U.S. Appl. No. 10/887,366 dated Apr. 22, 2009.
U.S. Office Communication from U.S. Appl. No. 12/044,087 dated Apr. 22, 2010.
U.S. Office Communication from U.S. Appl. No. 12/044,087 dated Jul. 30, 2010.
U.S. Office Communication from U.S. Appl. No. 12/725,254 dated Jun. 4, 2010.
Varpakhovich, G A; RU2057334C1: Method of Identification of Objects and Plant for its Realization; Mar. 27, 1996; pp. 1-2, Derwent Record (printed from www.delphion.com).
U.S. Office Communication from U.S. Appl. No. 09/586,648 dated Dec. 18, 2003.
U.S. Office Communication from U.S. Appl. No. 09/586,648, dated Aug. 26, 2004.
U.S. Notice of Allowance from U.S. Appl. No. 09/586,648 dated Sep. 29, 2005.
U.S. Office Communication from U.S. Appl. No. 10/323,536 dated Dec. 27, 2006.
U.S. Office Communication from U.S. Appl. No. 10/323,536 dated May 14, 2007.
U.S. Notice of Allowance from U.S. Appl. No. 10/323,536 dated Feb. 5, 2008.
U.S. Supplemental Notice of Allowance from U.S. Appl. No. 10/323,536 dated Apr. 11, 2008.
U.S. Office Communication from U.S. Appl. No. 09/843,998 dated Aug. 29, 2002.
U.S. Office Communication from U.S. Appl. No. 09/843,998 dated Mar. 28, 2003.
U.S. Office Communication from U.S. Appl. No. 09/843,998 dated Dec. 9, 2003.
U.S. Office Communication from U.S. Appl. No. 09/843,998 dated Jul. 28, 2004.
U.S. Office Communication from U.S. Appl. No. 09/843,998 dated Mar. 24, 2005.
U.S. Office Communication from U.S. Appl. No. 11/377,736 dated Oct. 18, 2006.
U.S. Office Communication from U.S. Appl. No. 11/377,736 dated May 7, 2007.
U.S. Office Communication from U.S. Appl. No. 11/377,736 dated Nov. 1, 2007.
U.S. Office Communication from U.S. Appl. No. 11/377,736 dated Jun. 12, 2008.
U.S. Office Communication from U.S. Appl. No. 11/377,736 dated Dec. 12, 2008.
U.S. Office Communication from U.S. Appl. No. 11/377,736 dated May 29, 2009.
U.S. Notice of Allowability from U.S. Appl. No. 09/286,650 dated Jul. 30, 2000.
U.S. Notice of Allowability from U.S. Appl. No. 09/286,650 dated Jan. 12, 2001.
U.S. Supplemental Notice of Allowability from U.S. Appl. No. 09/286,650 dated Oct. 12, 2001.
U.S. Office Communication from U.S. Appl. No. 09/656,720 dated Feb. 26, 2002.
U.S. Office Communication from U.S. Appl. No. 10/032,114 dated Aug. 13, 2003.
U.S. Notice of Allowability from U.S. Appl. No. 10/032,114 dated Feb. 24, 2004.
U.S. Office Communication from U.S. Appl. No. 10/726,027 dated Jul. 11, 2005.
U.S. Office Communication from U.S. Appl. No. 12/173,693 dated Jun. 4, 2009.
U.S. Notice of Allowability from U.S. Appl. No. 12/173,693 dated Aug. 21, 2009.
U.S. Office Communication from U.S. Appl. No. 12/044,087 dated Jan. 13, 2011.
U.S. Office Communication from U.S. Appl. No. 12/725,254 dated Nov. 2, 2010.
U.S. Office Communication from U.S. Appl. No. 12/044,087 dated May 24, 2011.
U.S. Office Communication from U.S. Appl. No. 12/564,780 dated Mar. 16, 2011.
U.S. Office Communication from U.S. Appl. No. 12/725,254 dated Apr. 14, 2011.
U.S. Office Communication from U.S. Appl. No. 12/044,087 dated Dec. 5, 2011.
U.S. Office Communication from U.S. Appl. No. 12/564,780 dated Aug. 24, 2011.
U.S. Office Communication from U.S. Appl. No. 13/081,926 dated Sep. 10, 2013.
U.S. Office Communication from U.S. Appl. No. 13/302,618 dated Jan. 10, 2013.
U.S. Office Communication from U.S. Appl. No. 13/302,618 dated Jun. 13, 2013.
U.S. Office Communication from U.S. Appl. No. 13/302,618 dated Sep. 9, 2013.
U.S. Office Communication from U.S. Appl. No. 12/044,087 dated Jun. 17, 2014.

* cited by examiner

FIG. 3B
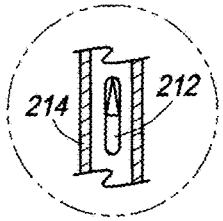
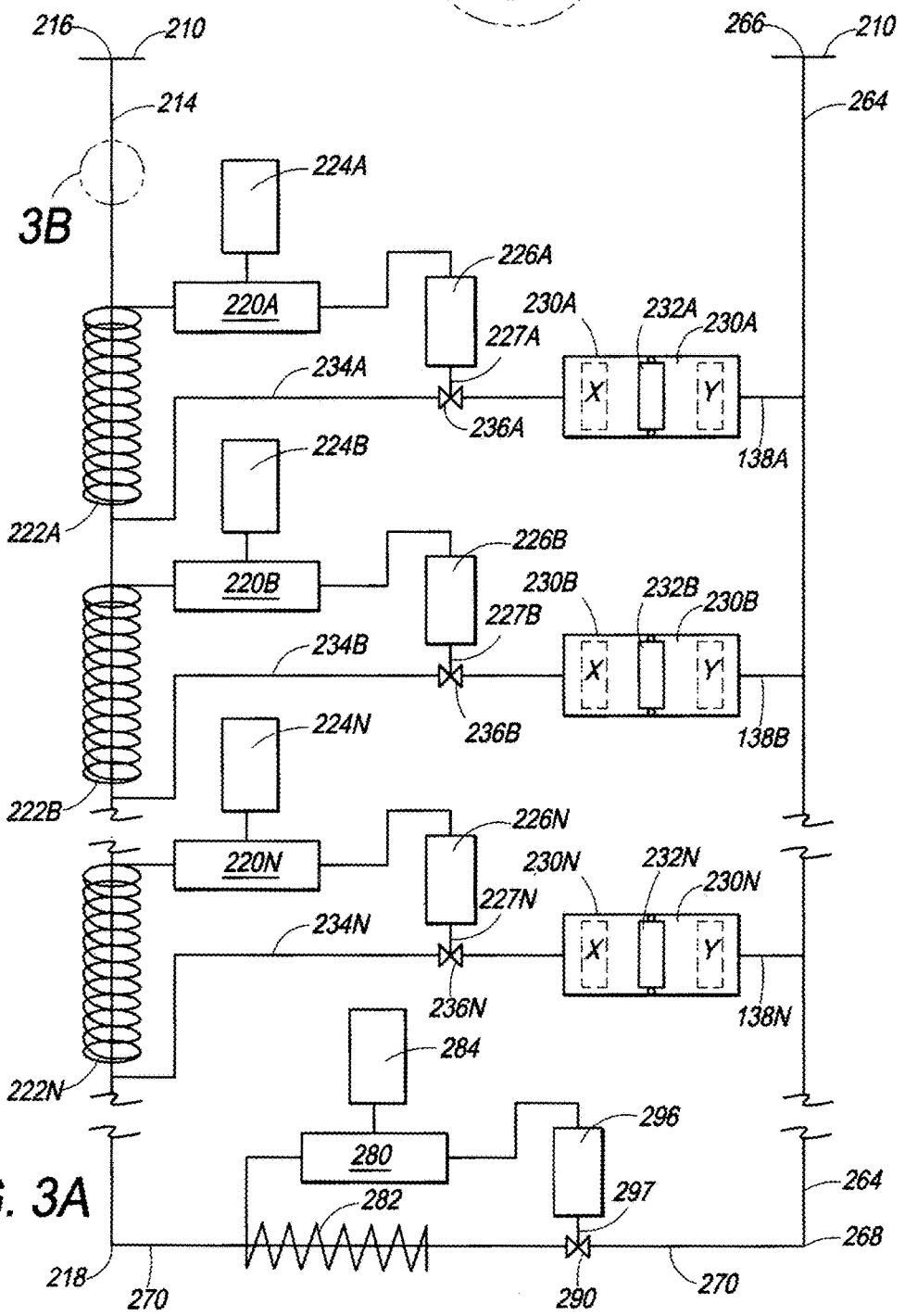
FIG. 3A

SYSTEMS, ASSEMBLIES AND PROCESSES FOR CONTROLLING TOOLS IN A WELL BORE

REFERENCE TO RELATED PATENT APPLICATION

This application is a continuation-in-part of copending U.S. patent application Ser. No. 12/044,087 filed on Mar. 7, 2008 and entitled "Systems, Assemblies and Processes for Controlling Tools in a Well Bore".

BACKGROUND OF THE INVENTION

Field of the Invention

The present invention relates to systems, assemblies and processes for controlling equipment, tools and the like that are positioned in a subterranean well bore, and more particularly, to systems, assemblies and processes for controlling a plurality of equipment, tools and the like that are positioned in a subterranean well bore.

Description of Related Art

In the production of fluid from subterranean environs, a well bore is drilled so as to penetrate one or more subterranean zone(s), horizon(s) and/or formation(s). The well is typically completed by positioning casing which can be made up of tubular joints into the well bore and securing the casing therein by any suitable means, such as cement positioned between the casing and the walls of the well bore. Thereafter, the well is usually completed by conveying a perforating gun or other means of penetrating casing adjacent the zone(s), horizon(s) and/or formation(s) of interest and detonating explosive charges so as to perforate both the casing and the zone(s), horizon(s) and/or formation(s). In this manner, fluid communication is established between the zone(s), horizon(s) and/or formation(s) and the interior of the casing to permit the flow of fluid from the zone(s), horizon(s) and/or formation(s) into the well. Alternatively, the well can be completed as an "open hole", meaning that casing is installed in the well bore but terminates above the subterranean environs of interest. The well is subsequently equipped with production tubing and convention associated equipment so as to produce fluid from the zone(s), horizon(s) and/or formation(s) of interest to the surface. The casing and/or tubing can also be used to inject fluid into the well to assist in production of fluid therefrom or into the zone(s), horizon(s) and/or formation(s) to assist in extracting fluid therefrom.

Often during the drilling and completion of a well or during production or injection of fluid from or into a well or subterranean environs, it can be desirable to control the operation of multiple tools, equipment, or the like, for example perforating guns, cutters, packers, valves, sleeves, etc., that can be positioned in a well. In the production of fluid from or injection of fluid into subterranean environs, multiple tools and equipment are often positioned and operated in a well bore. For example, a plurality of perforating guns can be deployed within a well bore to provide fluid communication between multiple zones, horizons and/or formations. Upon detonation, these guns file projectiles through casing cemented within the well bore to form perforations and establish fluid communication between the formation and the well bore. Often these perforating guns are detonated in sequence. A plurality of flapper valves can be used in conjunction with multiple perforating guns to isolate the zone, horizon or formation being completed from other zones, horizons and/or formations encountered by the well bore. As another example, packers can be deployed on a tubular and expanded into contact with casing to provide a fluid tight seal in the annulus defined between the tubular and the casing. Flow chokes can be used to produce the well from multiple zones with these chokes set at different openings to balance the pressure existing between multiple subterranean zones, horizons and/or formations so that a plurality of such zones, horizons and/or formations can be produced simultaneously.

Hydraulic systems have been used to control the operation of tools positioned in a well. Such systems have a control system and a down hole valve. The control system includes surface equipment, such as a hydraulic tank, pump, filtration, valves and instrumentation, control lines, clamps for the control lines, and one or more hydraulic controller units. The control lines run from the surface equipment to and through the wellhead and tubing hanger to desired equipment and tools in the well. These control lines are clamped usually along a tubular that is positioned within a well. The control lines can be connected to one or more hydraulic control units within a well for distributing hydraulic fluid to the down hole valves.

Several basic arrangements of hydraulic control lines are used in a well. In a direct hydraulic arrangement, each tool that is to be controlled will have two dedicated hydraulic lines. The "open" line extends from the surface equipment to the tool and is used for transporting hydraulic fluid to the downhole control valve to operate the tool, while the "close" line extends from the tool to the surface equipment and provides a path for returning hydraulic fluid to the surface of the earth. The practical limit to the number of tools that can be controlled using the direct hydraulic arrangement is three, i.e. six separate hydraulic lines, due to the physical restraints in positioning hydraulic lines in a well. The tubing hanger through which the hydraulic lines run also has to accommodate lines for a gauge system, at least one safety valve and often a chemical injection line, which limits the number of hydraulic lines the hanger can accommodate. When it is desirable to control more than three tools in a well, a common close arrangement can be employed in which an open line is run to each tool to be controlled and a common close line is connected to each tool to return hydraulic fluid to the surface. Again, the common close system has a practical limit of controlling five tools, i.e. six separate hydraulic lines.

In another arrangement, a single hydraulic line is dedicated to each tool and is connected to each tool via a separate, dedicated controller for each tool. To open the tool, the hydraulic fluid in the dedicated line is pressurized to a first level. Thereafter, the hydraulic fluid in the dedicated line is pressurized to a higher level so as to close the tool. In a digital hydraulics system, two hydraulic lines are run from the surface equipment to a downhole controller that is connected to each of the tools to be controlled. Each controller is programmed to operate upon receiving a distinct sequence of pressure pulses received through these two hydraulic lines. Each tool has another hydraulic line is connected thereto as a common return for hydraulic fluid to the surface. The controllers employed in the single line and the digital hydraulics arrangements are complex devices incorporating numerous elastomeric seals and springs which are subject to failure. In addition, these controllers use small, inline filters to remove particles from the hydraulic fluid that might otherwise contaminate the controllers. These filters are prone to clogging and collapsing. Further, the complex nature of the pressure sequences requires a computer operated pump and valve manifold which is expensive.

In accordance with the "distribution hub" arrangement, two hydraulic lines are run from the surface to one downhole controller to which each tool to be controlled is connected by its own set of two hydraulic lines. This controller can be ratcheted to any of a number of predetermined locations, each of which connects the control lines of a given tool to the control lines running from the surface to the controller. In this manner, each tool can be operated independently from the surface. By ratcheting the controller to another location, another tool can be operated. This arrangement is expensive due to the large number of components and complex arrangement of seals in the controller and unreliable as it is difficult to get feedback to the surface on the exact position of the controller, especially if the operator has lost track of the pulses previously applied. Thus, a need exists for hydraulic control systems, assemblies and processes for use in controlling multiple tools in a well which is relatively inexpensive, simple in construction and operation and reliable.

Further, it is often desirable to stimulate the subterranean environs of interest to enhance production of fluids, such as hydrocarbons, therefrom by pumping fluid under pressure into the well and the surrounding subterranean environs of interest to induce hydraulic fracturing thereof. Thereafter, fluid can be produced from the subterranean environs of interest, into the well bore and through the production tubing and/or casing string to the surface of the earth. Where it is desired to stimulate or fracture the subterranean environs of interest at multiple, spaced apart locations along a well bore penetrating the environs, fluid is pumped into a particular location adjacent the subterranean environs of interest that is farthest from the surface of earth while a means, such as a flapper valve(s), is employed to isolate the remaining locations. Once fluid is pumped under pressure from the surface into the well and the lowermost location, means are actuated to isolate the next location which is closest to the surface from the lowermost location and the remaining locations. Fluid is pumped under pressure from the surface into the well and the subterranean environs adjacent the isolated location so as to hydraulically fracture the same. In this manner, all of the subterranean environs adjacent to the multiple, spaced apart locations can be hydraulically fractured in sequence beginning at the location that is farthest from the surface along the well bore. Conventional systems and associated methodology that are used to stimulate subterranean environs in this manner include casing conveyed perforating systems, ball drop systems, and perforate and plug systems.

However, problems exist with hydraulically fracturing subterranean environs from multiple, spaced apart locations in sequence beginning with location that is farthest from the surface along the well bore. Hydraulic fracturing of subterranean environs creates stress forces in rock that essentially harden the particular regions of the subterranean formation fractured thereby inhibiting propagation of fractures created during hydraulic fracturing of an adjacent region into the region previously fractured. This can cause hydraulic fractures formed in the adjacent region to propagate away from the previously fractured region which may not be desirable. Accordingly, a need exists for a process for sequentially fracturing subterranean environs from spaced apart locations along the well bore in any desired sequence. A further need exists for a process for sequentially fracturing subterranean environs from spaced apart locations along the well bore in a sequence calculated to advantageously use rock stress generated in the subterranean environs to propagate fractures in a desired manner.

SUMMARY OF THE INVENTION

To achieve the foregoing and other objects, and in accordance with the purposes of the present invention, as embodied and broadly described herein, one characterization of the present invention is a hydraulic control system for use in a subterranean well is provided. The control system comprises a control line positioned in a subterranean well and extending adjacent at least one tool positioned within the subterranean well. The control line is sized to permit passage of a signal device and each of the at least one tool has a reader device connected thereto.

In another characterization of the present invention, a process is provided for conveying at least one signal device capable of generating one or more unique signals through a control line positioned in a subterranean well so as to control the operation of at least one tool positioned in the well outside of the control line.

In yet another characterization of the present invention, a process is provided for conveying hydraulic fluid via a first hydraulic line to at least one tool positioned in a subterranean well to control the operation of the tool. At least one signal device is conveyed through a control line positioned in the well and outside of the first hydraulic line and the at least one tool. Each of the at least one signal device is capable of generating one or more unique signals for controlling flow of hydraulic fluid from the first hydraulic line to the at least one tool.

In a further characterization of the present invention, a process is provided for fracturing a subterranean environs penetrated by a well at spaced apart locations along the well using tools that remain in the well. The sequence of fracturing comprises fracturing the subterranean environs at one of the spaced apart locations after fracturing the subterranean environs at another of the spaced apart locations which is closer to the surface of the earth along the well.

In a still further characterization of the present invention, a process is provided that comprises pumping fluid through casing positioned in a well and an opening in a first tool secured to the casing at a pressure sufficient to fracture a portion of a subterranean environs. Thereafter, fluid is pumped through the casing and an opening in a second tool secured to the casing at a pressure sufficient to fracture another portion of the subterranean environs. The second tool is farther along the well from the surface of the earth than the first tool.

In yet a still further characterization of the present invention, a process is provided that comprises fracturing a first portion of a subterranean environs penetrated by a well at a first location along the well using tools that remain in the well. Fracturing of the first portion creates rock stress within the first portion. A second portion of said subterranean environs is fractured at a second location along the well using the tools which results in fractures in the second portion that have a geometry influenced by the rock stress present in the first portion.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings:

FIG. 3A is a schematic view of a further embodiment of the systems and assemblies of the present invention that utilizes two hydraulic lines that extend to the surface;

FIG. 3B is a sectional view of a hydraulic control line of FIG. 3A having a signal device therein;

DETAILED DESCRIPTION OF THE PREFERRED EMBODIMENTS

As utilized throughout this description, the term "signal control line" refers to a continuous or jointed line, conduit, tubular or similar structure for conveying fluid and a signal device. The substantially axial bore through the control line is sufficient to permit passage of a signal device therethrough but the outside diameter of the control line is sufficiently small so as not to impede placement of other lines, tubulars, tools and equipment within the well. A nonlimiting example of suitable diameters for a signal control line are an outside diameter of from about 0.25 inch to about 0.50 inch and a substantially axial bore diameter of from about 0.15 inch to about 0.40 inch. The diameter of the substantially axial bore through the signal control line used in accordance with the present invention is not sufficient to allow commercial quantities of formation fluids to be produced therethrough. The signal control line can be constructed of any suitable material, for example stainless steel or a stainless steel alloy. A "signal device" refers to a device which is capable of generating one or more unique signals. Nonlimiting examples of a signal device are a radio frequency identification device (RFID), a device carrying a magnetic bar code, a radioactive device, an acoustic device, a surface acoustic wave (SAW) device, a low frequency magnetic transmitter and any other device that is capable of generating one or more unique signals. The signal device can have any suitable peripheral configuration and geometric shape, and is sized to permit conveyance through the signal control line. Some signal devices, for example RFID, can require a peripheral configuration and geometric shape to inhibit tumbling of the RFID during conveyance through the signal control line. A suitable RFID is commercially available from Sokymat SA, Switzerland under the trade name "Glass Tag 8 mm Q5". A "reader device" refers to a device capable of transmitting signals to and receiving signals from a signal device.

Figure 1A:
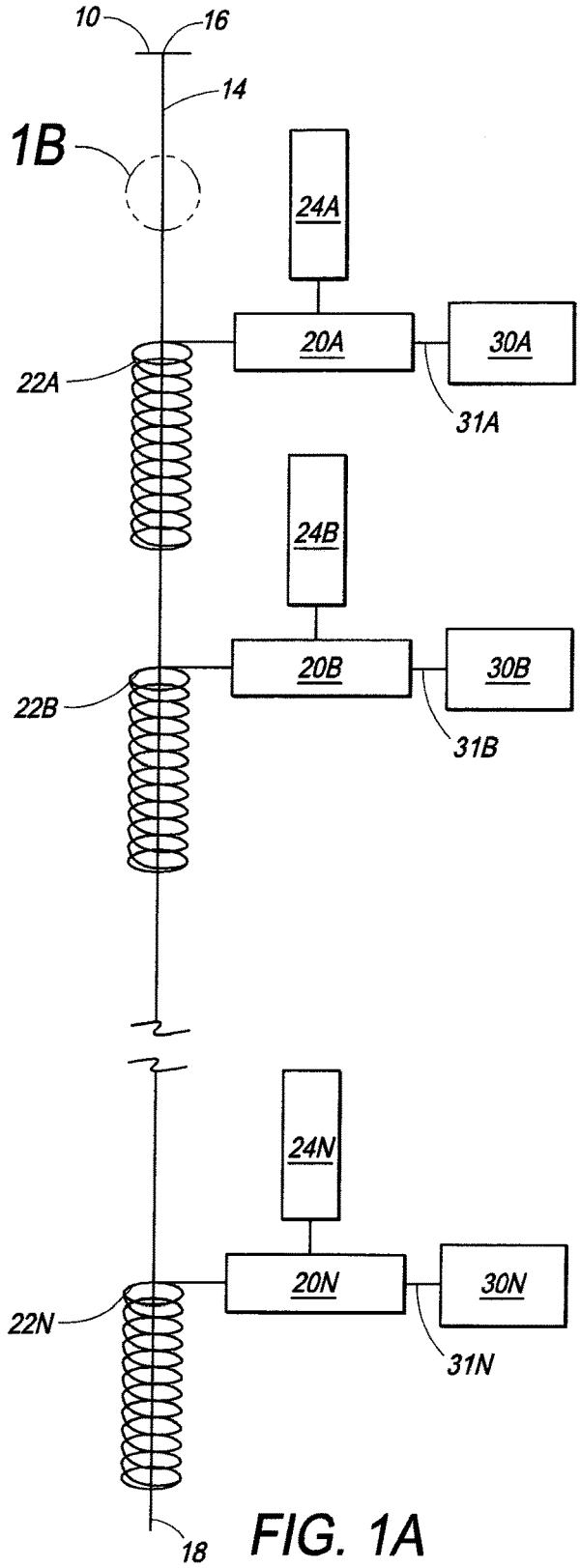
FIG. 1A is a schematic view of one embodiment of the systems and assemblies of the present invention that utilizes a dedicated control line.

In accordance with one embodiment of the present invention as illustrated in FIG. 1, a signal control line 14 can be positioned in a subterranean well and extend from the well head 10 to a position at least adjacent to the most remote tool from the well head that is desired to be controlled by the processes of the present invention. Signal control line 14 has a first end 16 at or near the well head 10 and a second end 18 located in the well. Although signal control line 14 can be supported from the well head and unattached as positioned in the well, it is preferably secured to tubulars and/or tools positioned in a well by any suitable means, for example by clamps, and can be armored as will be evident to a skilled artisan. Signal control line can be open at end 18 thereof to the well bore. One or more tools or equipment 30A, 30B and 30N can be positioned in a well and can be connected to reader devices 20A, 20B and 20N, respectively. Tools 30A, 30B and 30N can be connected to the associated reader devices 20A, 20B and 20N by any suitable means, such as via a hydraulic or electric line or acoustic connection 31A, 31B and 31N. Each reader device is connected to a suitable power source 24A, 24B, and 24N and antennas 22A, 22B and 22N, respectively. Nonlimiting examples of suitable power sources are batteries. As illustrated, antennas 22 can be coiled to surround control line 10 such that the orientation of signal device 12 within control line 10 is immaterial to the reception of a signal by antenna 22. An unlimited number of tools 30 can be controlled by the present invention, with the total number of tools that are positioned in a well and capable of being controlled by the present invention being designated by the letter "N".

Figure 1B:
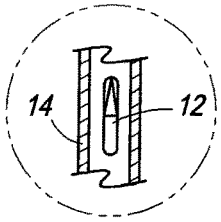
FIG. 1B is a sectional view of a hydraulic control line of FIG. 1A having a signal device therein.

In operation, a suitable signal device 12 can be conveyed from the well head 10 through line 14, for example in suitable fluid, such as hydraulic oil or water, that can be pumped by equipment located at the surface. The signal device 12 is sized and configured to inhibit the signal device from tumbling in line 14 during conveyance (FIG. 1B). Each signal device 12 is programmed to generate a unique signal. Similarly, each reader device 20A, 20B and 20N is programmed to look for a unique code signal. As the signal device 12 passes in proximity to a reader device 20, the unique signal transmitted by signal device 12 can be received by an antenna 22. If a given reader device 20 is programmed to respond to the signal transmitted by the device 12 via the associated antenna 22, the reader device 20 transmits a corresponding control signal to the associated tool 30 to actuate the tool. Reader devices 20 can also transmit signals which in turn are received by and cause signal device 12 to generate the unique signal.

Each reader device 20 can be programmed to respond to its own unique signal or the same signal of at least one other reader device. As the signal device 12 is conveyed through line 14, the unique signal transmitted thereby can be received and read by each successive reader device. If the unique signal matches that programmed in the reader device, the reader device transmits a control signal to actuate the associated tool 30. Ultimately, the signal device 12 exits through the end of the control line 14 into the well. Thereafter, one or more additional control signal devices can be conveyed via control line 14 to actuate one or more tools 30 in any sequence and manner desired. In this manner, an unlimited number of tools can be actuated by conveying one or more signal devices via control line 14. When line 14 is open at end 18 to the well bore, it is subject to hydrostatic fluid, and as such, the hydraulic pressure exerted in this line must be sufficient to overcome this pressure so as to convey signal device 12 through line 14.

Figure 2B:
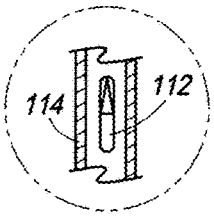
FIG. 2B is a sectional view of a hydraulic control line of FIG. 2A having a signal device therein.
Figure 2A:
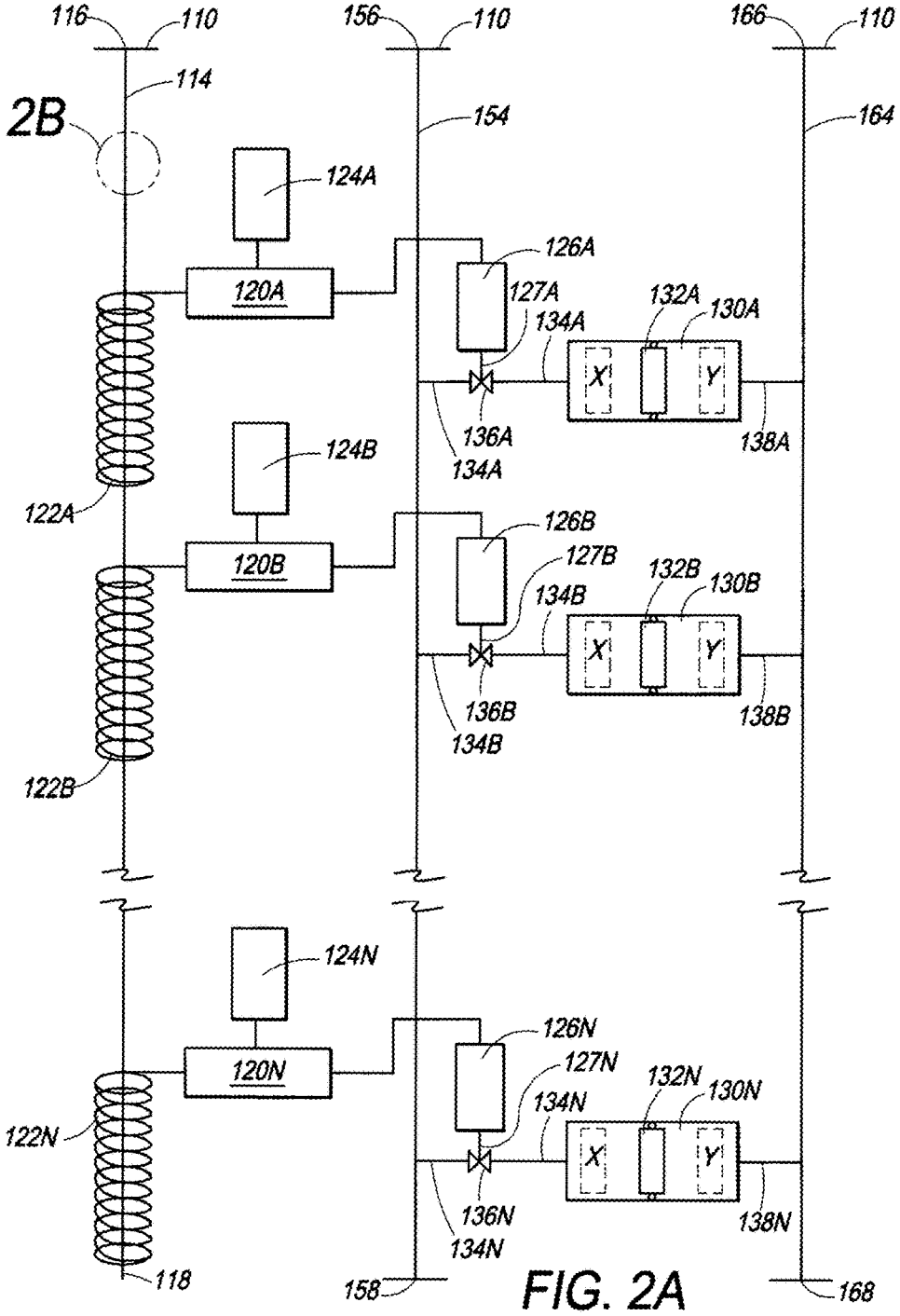
FIG. 2A is a schematic view of another embodiment of the systems and assemblies of the present invention that utilizes three hydraulic lines that extend to the surface.

In accordance with another embodiment of the present invention as illustrated in FIG. 2, three hydraulic lines 114, 154 and 164 can be positioned in a subterranean well and extend from the well head 110 to a position at least adjacent to the most remote tool from the well head that is desired to be controlled by means of this embodiment of the present invention. Each line 114, 154 and 164 has a first end 116, 156, 166, respectively, at or near the well head 110 and a second end 118, 158 and 168 located in the well. Second end 118 or line 114 can be open to the well and therefore the hydrostatic pressure of any fluid that is present in the well, while ends 158 and 168 of lines 156 and 166, respectively, can be capped or plugged as illustrated in FIG. 1 by any suitable means as will be evident to a skilled artisan. Alternatively, the end 116 of control line 114 can be connected to either end 158 of control line 154 or end 168 of control line 164 to permit the signal device 112 to be conveyed through line 114 and back to the surface through line 154 or line 164. Although lines 116, 156 and 166 can be supported from the well head and unattached as positioned in the well, each line is preferably secured to tubulars and/or tools positioned in a well by any suitable means, for example by clamps, and can be armored as will be evident to a skilled artisan.

A plurality of tools or equipment 130A, 130B and 130N are positioned in a well and can have a piston or sleeve 132A, 132B and 132N, respectively, moveably secured therein. Each tool 130A, 130B and 130N can be connected to hydraulic line 154 by means of lines 134A, 134B and 134N, respectively, each of which has a corresponding valve 136A, 136B and 136N. Each tool 130A, 130B and 130N can also be connected to hydraulic line 164 by means of lines 138A, 138B and 138N, respectively. Reader devices 120A, 120B and 120N are electrically connected to a suitable power source 124A, 124B, and 124N and antennas 122A, 122B and 122N, respectively. Nonlimiting examples of suitable power sources are batteries. These power sources can be preprogrammed to be in a sleep mode except for certain predetermined periods of time so as to conserve power consumption and therefore extend the life of the power source. As illustrated antennas 122A, 122B and 122N are coiled to surround control line 114 such that the orientation of the signal device 112 within control line 114 is immaterial. Each reader device 120A, 120B and 120N can be electrically connected to corresponding motors 126A, 126B and 126N, respectively, which in turn drive shaft or stem 127A, 127B and 127N to open or close valves 136A, 136B and 136N as will be evident to a skilled artisan. An unlimited number of tools 130 can be controlled by this embodiment of the present invention, with the total number of tools that are positioned in a well and capable of being controlled being designated by the letter "N". Hydraulic fluid, such as hydraulic oil or water, can be used in each of the three hydraulic lines and can be pressurized by any suitable means, such as a pump located at or near the well head, to a pressure sufficient to overcome the hydrostatic pressure of fluid present in the well to move from the well head through fluid and signal device 112 a hydraulic line and into the well.

As typically positioned in a well, valves 136A, 136B and 136N are in a closed positioned and pistons 132A, 132B and 132N are positioned to one end of the respective tool 130 as noted by the positions x or y in FIG. 2. While the tools 130 are illustrated in FIG. 2 as having a position generally on each end and in the center of the tool, the piston can be able to achieve several positions along the tool and have an associated mechanism, such as a collet, to allow this to be accomplished. A nonlimiting example of a tool utilizing a piston having variable positions is a variable choke installed in a tubular positioned in a well.

In operation, a suitable signal device 112 can be conveyed from the well head 110 through line 114, for example in fluid pumped by equipment located at the surface. Each signal device 112 is programmed to generate a unique signal. Similarly, each reader device 120A, 120B and 120N is programmed to look for a unique code signal. As the signal device 112 passes in proximity to a given reader device 120, the unique signal transmitted by signal device 112 can be received by an antenna 122. If a given reader device 120 is programmed to respond to the signal transmitted by the device 112 via the associated antenna 122, the reader device 120 transmits a corresponding control signal to the associated motor 126 which in turn causes valve 136 to open via shaft 127. Reader devices 120 can also transmit signals which in turn are received by and cause signal device 112 to generate the unique signal. As hydraulic fluid in line 154 is thereby permitted to flow through line 134 and valve 136, the pressure of the hydraulic fluid causes piston 132 in tool 130 to move to the desired position and thereby actuate the tool. Movement of the piston 132 in tool 130 causes the hydraulic fluid on the other side of piston 132 to flow back to the well head 110 via hydraulic line 164. To move piston 132 to a different position, pressure on the hydraulic fluid in line 154 or line 164 can be increased to move the piston with the associated mechanism, such as a collet, thereby permitting the piston to sequentially achieve several positions along the tool 130.

Each reader device 120 can be programmed to respond to its own unique signal or the same signal of at least one other reader device. As the signal device 112 is conveyed through line 114, the unique signal transmitted thereby can be received and read by each successive reader device. If the unique signal matches that programmed in the reader device, the reader device transmits a control signal to open the associated motor 126 and valve 136. Ultimately, the signal device 112 exits through the end of the control line 114 into the well. Thereafter, one or more additional motor(s) 126 and valve(s) 136 in any sequence and manner desired. In this manner, an unlimited number of tools 130 can be actuated by conveying one or more signal devices via control line 114. As line 114 is open at end 118 to the well bore, it is subject to hydrostatic fluid and as such the hydraulic pressure exerted in this line must be sufficient to overcome this pressure so as to convey signal device 112. Alternatively, line 114 can be connected to line 158 thereby permitting passage of signal device 112 to the surface. Signal device 112 can be configured to receive a signal from a given reader device that the unique signal conveyed by the signal device was received by the reader device. In this instance, the reader devices 120 are transceivers permitting each device to receive a unique signal from the signal device and to transmit another unique signal back to the signal device. Each signal device 112 can also be equipped with suitable gauges to measure well, formation, and/or fluid conditions which can then be recorded in signal device 112. Nonlimiting examples of suitable gauges are temperature and pressure gauges. Information contained in the signal device 112 can be read at the surface, erased from the signal device 112, if desired, and the signal device can be programmed to emit another unique signal for use in the same well or another well.

To close each valve 136, each associated reader device can be preprogrammed to actuate the appropriate motor 126 and shaft 127 after a period of time to close the associated valve 136. Alternatively, a signal device 112 can be conveyed via line 114 to transmit a unique signal to the appropriate reader device 120 via antenna 122 which in turn transmits a corresponding control signal to the associated motor 126 causing shaft 127 to close valve 136.

In accordance with another embodiment of the present invention as illustrated in FIG. 3, two hydraulic lines 214 and 264 are positioned in a subterranean well and extend from the well head 110 to a position at least adjacent to the most remote tool from the well head that is desired to be controlled by means of this embodiment of the present invention. Lines 214 and 264 have a first end 216 and 266, respectively, at or near the well head 210 and a second end 218 and 268 secured and in fluid communication with a line 270. Although lines 216 and 266 can be supported from the well head and unattached as positioned in the well, each line, including line 270, is preferably secured to tubulars and/or tools positioned in a well by any suitable means, for example by clamps, and can be armored as will be evident to a skilled artisan.

In the embodiment of the present invention illustrated in FIG. 3, each tool 230A, 230B and 230N can be connected to hydraulic line 214 by means of lines 234A, 234B and 234N, respectively, each of which has a corresponding valve 236A, 236B and 236N. Each tool 230A, 230B and 230N can also be connected to hydraulic line 164 by means of lines 138A, 138B and 138N, respectively. Valves 236A, 236B and 236N are initially in the closed position as the system is deployed in a well, while valve 290 in line 270 connecting the lower ends of 218, 268 of lines 214 and 264 together is initially in the open position. To begin operation, a unique signal device 212 can be conveyed via line 214 by any suitable means, for example hydraulic oil. The unique signal transmitted by signal device 212 can be received by each antenna 222A, 222B and 222N and conveyed to each associated reader device 220A, 220B and 220N. If a given reader device has been preprogrammed to respond to the received signal, that reader device actuates at least one motor 226A, 226B or 226N to open the associated valve 236A, 236B or 236N via the appropriate shaft 227A, 227B or 227N. The signal device then passes through line 270 and conveys a signal to reader device 280 via antenna 282. Reader device 280, which can be powered by power source 284, in turn activates motor 296 to close valve 290 via shaft 297. Each signal device can be configured to receive a signal from a given reader device that the unique signal conveyed by the signal device was received by the reader device. In this instance, the reader devices 220 are transceivers permitting each device to receive a unique signal from the signal device and to transmit another unique signal back to the signal device. Each signal device 212 can also be equipped with suitable gauges to measure well, formation, and/or fluid conditions which can then be recorded in signal device 212. Nonlimiting examples of suitable gauges are temperature and pressure gauges. With valve 290 closed, hydraulic fluid can be directed via line 214 to that valve(s) 236 that was opened by the unique signal device 212 to move piston 232 to a desired position. Valves 236A, 236B and 236N are in a closed positioned and pistons 232A, 232B and 232N are positioned to one end of the respective tool 230A, 230B and 230N as noted by the positions x or y in FIG. 3. While the tools 230 are illustrated in FIG. 3 as having a position generally on each end and in the center of the tool, the piston can be able to achieve several positions along the tool and have an associated mechanism, such as a collet, to allow this to be achieved. Reader device 280 can be programmed to cause valve 290 to open a predetermined time after being closed or the unique signal(s) from signal device 212 can contain instructions to cause the reader device to open valve 290 in a predetermined amount of time. Once valve 290 is open, signal device 212 can be conveyed to the well head 210 via line 264 by pressurizing hydraulic fluid in line 214. Information contained in the signal device 212 can be read at the surface, erased from the signal device 212, if desired, and the signal device can be programmed to emit another unique signal for use in the same well or another well.

Figure 4A:
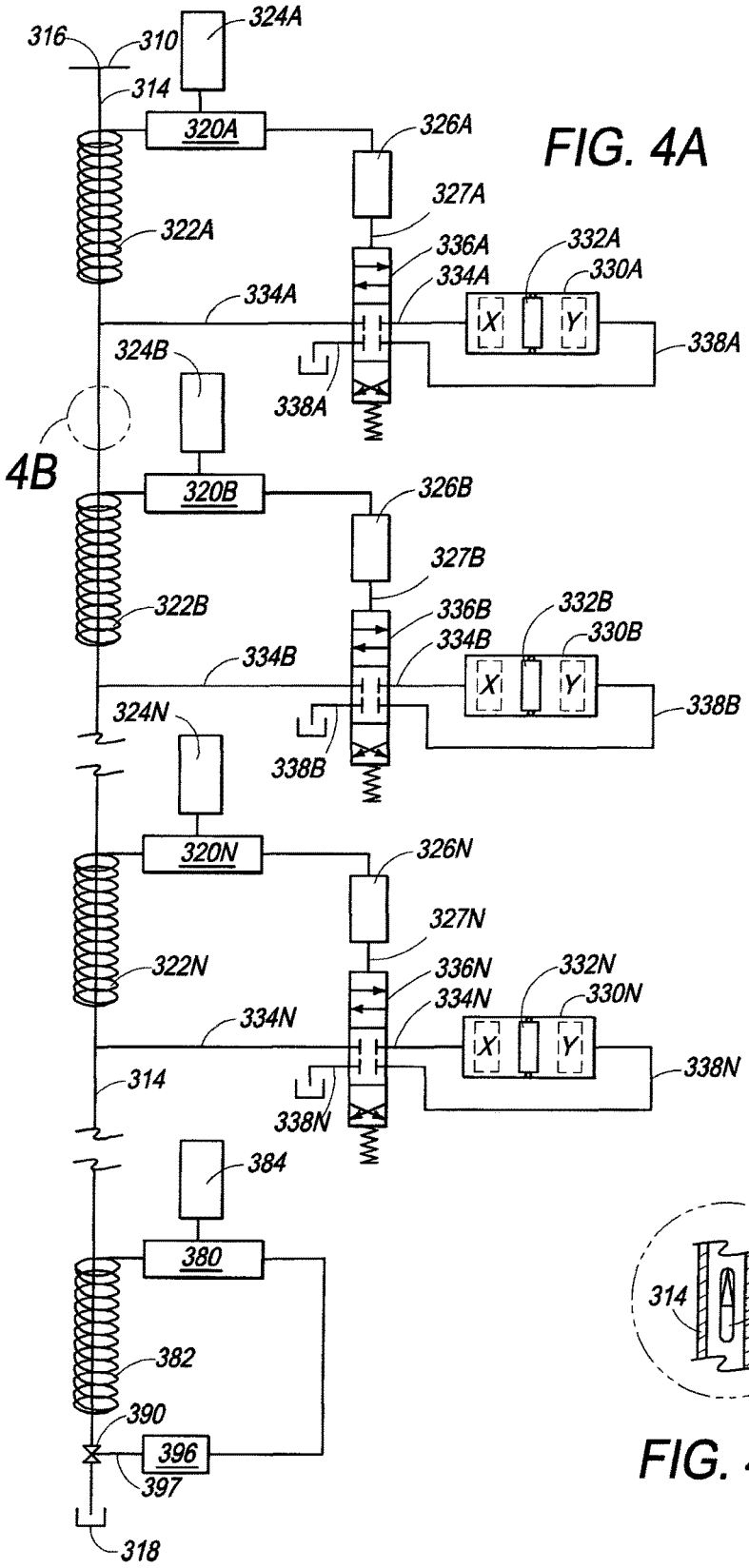
FIG. 4A is a schematic view of still further embodiment of systems and assemblies of the present invention that utilizes one hydraulic line that extends to the surface.
Figure 4B:
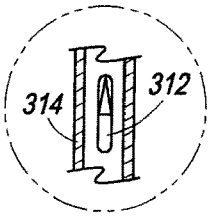
FIG. 4B is a sectional view of a hydraulic control line of FIG. 4A having a signal device therein.

In the embodiment of the present invention illustrated in FIG. 4, one hydraulic line 314 can be positioned in a subterranean well and extends from the well head 310 to a position at least adjacent to the most remote tool from the well head that is desired to be controlled by means of this embodiment of the present invention. Line 314 has a first end 316 at or near the well head 310 and a second end 318 open to the well. Hydraulic line 314 is also equipped with a valve 390 which is initially in an open position. Although line 314 can be supported from the well head and unattached as positioned in the well, line 314 is preferably secured to tubulars and/or tools positioned in a well by any suitable means, for example by clamps, and can be armored as will be evident to a skilled artisan. One or more tools 330 are positioned in the well by means of continuous or jointed tubulars or wireline. The letter "N" represents the total number of tools and associated equipment that are positioned in the well and assembled as capable of being controlled in accordance with the system and process of this embodiment of the present invention. Tools 330 are connected to hydraulic line 314 by means of associated hydraulic lines 334 and have pistons 332 positioned therein. Pistons 332A, 332B and 332N are positioned to one end of the respective tool 330 as noted by the positions x or y in FIG. 4. While the tools 330 are illustrated in FIG. 4 as having a position generally on each end and in the center of the tool, the piston can be able to achieve several positions along the tool and have an associated mechanism, such as a collet, to allow this to be achieved. A nonlimiting example of a tool utilizing a piston having variable positions is a variable choke installed in a tubular positioned in a well.

Change-over valves 336 are positioned in hydraulic lines 334 and are connected to and controlled by motors 326 and shafts 327. Reader devices 320A, 320B and 320N are electrically connected to a suitable power source 324A, 324B, and 324N and antennas 322A, 322B and 322N, respectively. Nonlimiting examples of suitable power sources are batteries. These power sources can be preprogrammed to be in a sleep mode except for certain predetermined periods of time so as to conserve power consumption and therefore extend the life of the power source. As illustrated, antennas 322A, 322B and 322N are coiled to surround control line 314 such that the orientation of the signal device 312 within control line 314 is immaterial. Each reader device 320A, 320B and 320N is electrically connected to corresponding motors 326A, 326B and 326N, respectively, which in turn drive shaft or stem 327A, 327B and 327N to open or close valves 336A, 336B and 336N as will be evident to a skilled artisan.

Another reader device 380 is electrically connected to a suitable power source 384 and antenna 382 which is configured to surround hydraulic line 314. Reader device 380 is also electrically connected to motors 396 which drives shaft or stem 397 to open or close valve 390 as will be evident to a skilled artisan.

In operation, a signal device 312 can be conveyed via line 314, through open valve 390 and open end 318 into the well for example in fluid pumped by equipment located at the surface. Each signal device 312 is programmed to generate a unique signal. Similarly, each reader device 320A, 320B and 320N is programmed to look for a unique code signal. As the signal device 312 passes in proximity to a given reader device 320, the unique signal transmitted by signal device 312 can be received by an antenna 322. If a given reader device 320 is programmed to respond to the signal transmitted by the device 312 via the associated antenna 322, the reader device 320 transmits a corresponding control signal to the associated motor 326 which in turn causes valve 336 to open via shaft 327. Reader devices 320 can also transmit signals which in turn are received by and cause signal device 312 to generate the unique signal. Antenna 382 conveys a signal received from signal device 312 to actuate motor 396 and shaft 397 to close valve 390. Thereafter, hydraulic fluid in line 314 is thereby permitted to flow through line 334 and valve 336 thereby causing piston 332 in tool 330 to move to the desired position and thereby actuate the tool. Hydraulic fluid flowing around a given piston 332 is permitted to flow back into the well via hydraulic line 338. Reader device 380 can be programmed to cause valve 390 to open a predetermined time after being closed or the unique signal from signal device 312 can contain instructions to cause the reader device to open valve 390 in a predetermined amount of time.

Figure 5A:
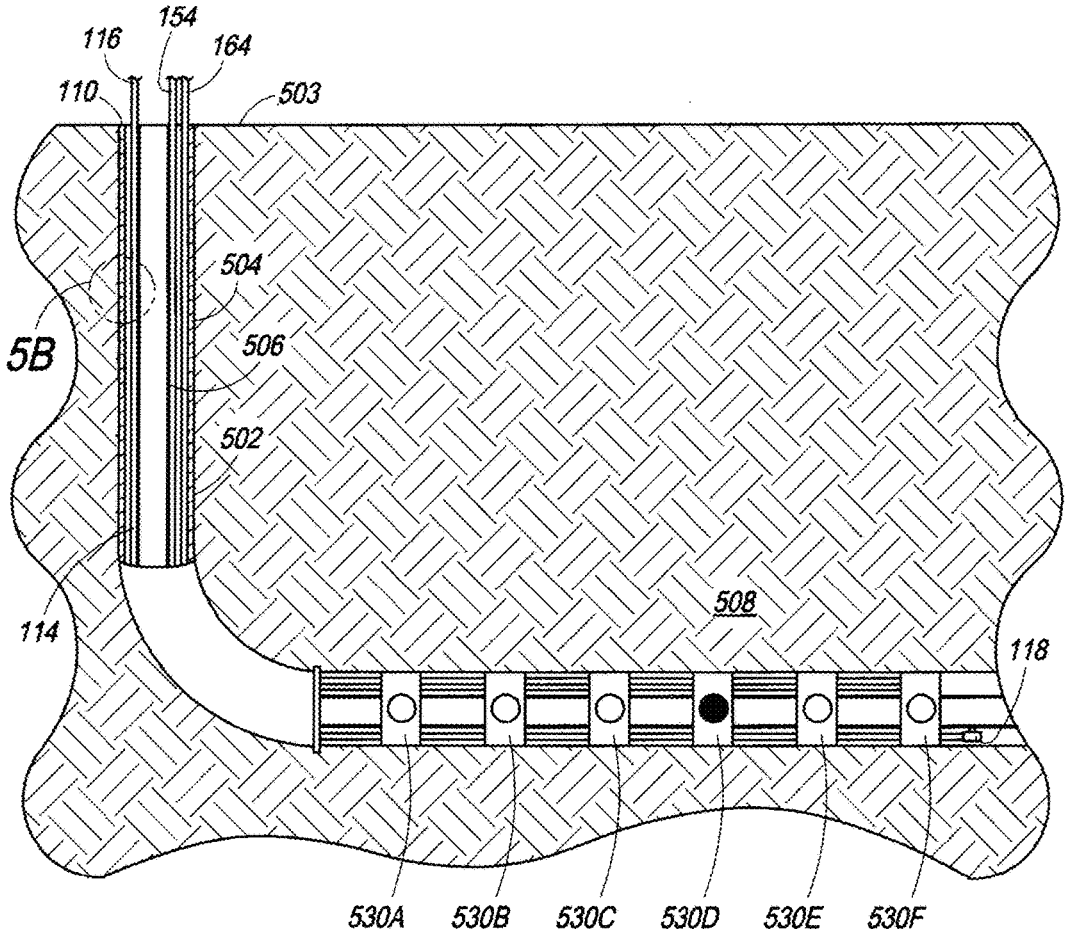
FIG. 5A is a partially cross sectional illustration of the embodiment of the present invention that utilizes three hydraulic lines as deployed in a subterranean well.
Figure 5B:
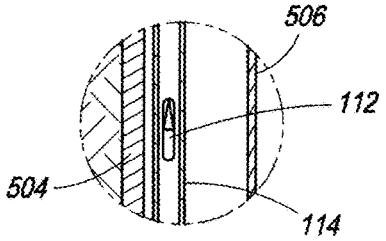
FIG. 5B is a sectional view of the hydraulic control lien of FIG. 5A having a signal device therein.

FIG. 5 illustrates substantially the embodiment of the present invention depicted schematically in FIG. 2 as deployed in a subterranean well. In FIG. 5 a subterranean well 502 extends from the surface of the earth 503 and penetrates one or more subterranean environs 508 of interest. As used throughout this description, the term "environs" refers to one or more subterranean areas, zones, horizons and/or formations that can contain hydrocarbons. Although the well 502 can have any suitable subterranean configuration as will be evident to a skilled artisan, the well is illustrated in FIG. 5 as having a generally horizontal configuration through the subterranean environs 508 of interest. The well can be provided with intermediate casing 504 which can be secured within the well 502 by any suitable means, for example cement (not illustrated), as will be evident to a skilled artisan. The intermediate casing is illustrated in FIG. 5 as extending from the surface of the earth to a point near the subterranean environs 508 of interest so as to provide an open hole completion through a substantial portion of the subterranean environs 508 of interest that are penetrated by well 502. Production casing 506 is also positioned within the well and is sized to extend through the casing and into the open hole of well 502 within the subterranean environs 508. Production casing 506 is further provided with a one or more tools 530A-F which are sliding sleeves as illustrated in FIG. 5 to selectively provide a fluid communication between the environs 508 and the interior of production casing 506. A control line 114 has a first end 116 at or near the well head 110 and extends in the annulus between the intermediate casing 504 and production casing 506 to each of the tools 530 A-F. The other end of 118 of the control line 114 extends into the open hole of well 502 outside of production casing 506. Hydraulic lines 154 and 164 each extend from the surface of the earth at or near the wellbore to at least to a point in the well adjacent to the distal tool 530 F so as to allow hydraulic connection thereto in a manner is illustrate in FIG. 2. Although lines 116, 156 and 166 can be supported from the well head and unattached as positioned in the well, each line is preferably secured to the exterior of production casing 506 by any suitable means, for example by clamps, and can be armored as will be evident to a skilled artisan. Thereafter, a control device 112 can be conveyed through control line 114 to selectively, hydraulically operate the sliding sleeves in tools 530 A-F in a manner as described above with reference to FIG. 2. The arrangement of sliding sleeves depicted in FIG. 5 can be employed to selectively and sequentially fracture the subterranean formation(s), zone(s) and/or reservoir(s) 508 of interest adjacent the open sleeve.

In accordance with an embodiment of the fracturing process of the present invention, a signal device 112 can be conveyed through control line 114 to selectively, hydraulically operate the sliding sleeves in tools 530 A-F in a manner as described above with reference to FIG. 2. The arrangement of sliding sleeves depicted in FIG. 5 can be selectively opened to permit hydraulic fracturing of the subterranean environs 508 of interest adjacent the open sleeve(s) in any desired sequence. The sliding sleeves in tools A-F can be opened in any desired sequence and are not limited to being opened in sequence beginning with the sleeve of the tool positioned farthest from the surface, i.e. the sleeve in tool 530 F. Often it can be advantageous to open the sleeve adjacent the area of subterranean environs 508 farthest from the surface along well 502 last in the sequence where fracturing fluid contains a gas as this gas can energize fluid produced from the subterranean environs thereby facilitating production thereof. Further, the sliding sleeves in tools 530 A-F can be opened individually or the sliding sleeves in more than one of the tools 530 A-F can be opened at the same time the and the subterranean environs adjacent each opened sleeve can be fractured simultaneously. Once a sleeve is opened, suitable fluid is pumped through casing 506 and the opened sleeve(s) at a pressure that is sufficient to hydraulically fracture the subterranean environs adjacent the opened sleeve(s). Additionally, the sleeves in one or more of tools 530 A-F can be opened simultaneously or in any sequence during production of fluid from the subterranean environs 508 through casing 502 to the surface 503.

The generally annular area 505 between well 502 and production casing 506 typically contains fluid. In addition, fluid can be injected from the surface of the earth 503 via well 502 and positioned in annular area 505 to form a fluid tight barrier which can be broken down at the location of fluid injected during a fracturing operation so as to provide fluid communication between fractured areas of the subterranean environs 508 and production casing 506 via opened sliding sleeve(s) in tool(s) 530A-F. The fluid injected into annular areas 505 can be a viscous fluid or a fluid which sets up to form a generally solid barrier. A nonlimiting example of the latter fluid is a crosslinked gel which sets up after being positioned in the annular area and can be formulated so as to break down after a predetermined amount of time. Another nonlimiting example of the latter fluid is cement.

Rock stress generated during fracturing of an area of subterranean environs 508 causes the rock in the fractured area to be resistant to the propagation therein of fractures from a subsequently fractured adjacent area. This rock stress can be used In accordance with another embodiment of the fracturing process of the present invention, to propagate fractures that are subsequently created in the subterranean environs in a desired manner. For example, the area of subterranean environs 508 located adjacent the sleeve in tool 530D can be fractured and either simultaneously therewith or thereafter the area of subterranean environs 508 located adjacent the sleeve in tool 530F can be fractured. Subsequently, the area of subterranean environs located adjacent the sleeve in tool 530E is fractured and, because the previously fractured areas of subterranean environs 508 are resistant to fracture propagation, more energy is directed and the fractures formed in the area surrounding tool 530E are propagated farther away from the well 502. The sleeves in tools 530A-F can be opened in any desired sequence to take advantage of rock stress created during the fracturing process to propagate fractures either farther away from the well or in a given axial direction away from the stressed area as will be evident to a skilled artisan.

The following example demonstrates the practice and utility of the present invention, but is not to be construed as limiting the scope thereof.

EXAMPLE 1

A well is drilled to total depth (TD) so as to penetrate a subterranean formation of interest and the drilling assembly is removed from the well. A 7 inch outer diameter intermediate casing is positioned in the well to extend substantially from the surface of the earth to a point above the subterranean formation of interest. The intermediate casing is cemented to the well bore by circulating cement. Excess cement is drilled from the intermediate casing and well bore extending below the intermediate casing through the subterranean zone of interest.

A 3.5 inch outer diameter production casing is equipped with 6 sliding sleeves and has 3 hydraulic lines attached to the outside of the production casing. The sliding sleeves are arranged in series and referred to hereafter as sliding sleeves 1-6, with sliding sleeve 1 being proximal and sliding sleeve 6 being distal the intermediate casing. The hydraulic lines are a control line, a hydraulic power open line and a hydraulic power close line. The end of the production casing has a cementing shoe and a check valve assembly. The production casing and associated equipment and lines is lowered into the well until all sleeves which are in the closed position are in the open hole (portion of the well without intermediate casing).

Water-based, cross-linked fluids are pumped down the production casing and placed in annulus between the production casing and the open hole from TD to above sliding sleeve 1. The fluids are displaced with wiper plug that is conveyed through the production casing and latches in place at the bottom thereof so as to prevent flow of well fluids into the production casing. The fluids are allowed to thicken and create zonal isolation barriers.

A radio frequency identification device (RFID) encoded with specific code is pumped down the control line to actuate the shuttle valve in distal sliding sleeve from the intermediate casing (sleeve 6). Actuation is achieved by means of a radio frequency transceiver associated with the sliding sleeve. Approximately 7 gallons of hydraulic fluid are required to pump the RFID through the control line and into the well. Approximately 3,000 psi pressure is applied via hydraulic fluid in the power open line to open sliding sleeve 6. No pressure should be applied to the power close line so that minor fluid returns can occur as the piston in the sliding sleeve moves positions. After some time period, the shuttle valve in sliding sleeve 6 should close, locking the sleeve in the open position. Thereafter, approximately 3,000 barrels of fluid are pumped through the production casing, open sleeve 6 and into the formation adjacent sliding sleeve 6 so as to fracture and stimulate production of fluids from this adjoining formation. Sand can be incorporated into the stimulation fluid if desired.

Another RFID chip encoded with a specific code down is pumped down control line to actuate the shuttle valve in sliding sleeve 6. Approximately 3,000 psi pressure is applied via hydraulic fluid in the power close line to close sliding sleeve 6. No pressure should be applied to the power open line so that minor fluid returns can occur as the piston in the sliding sleeve moves positions. After some time period the shuttle valve in sliding sleeve 6 should close, locking the sleeve in the closed position. Thereafter, the production casing is pressure tested to confirm integrity. A RFID encoded with a specific code is pumped down the control line to actuate the shuttle valve in sliding sleeve 5. Approximately 3,000 psi pressure is applied to the hydraulic fluid in power open line to open sliding sleeve 5. No pressure should be applied to the power close line so that minor fluid returns can occur as the piston in the sliding sleeve moves positions. After some time period the shuttle valve in sliding sleeve 5 should close, locking the sleeve in the open position.

Thereafter, approximately 3,000 barrels of fluid are pumped through the production casing, open sleeve 5 and into the formation adjacent sliding sleeve 5 so as to fracture and stimulate production of fluids from this adjoining formation. Sand can be incorporated into the stimulation fluid if desired.

Another RFID chip encoded with a specific code down is pumped down control line to actuate the shuttle valve in sliding sleeve 5. Approximately 3,000 psi pressure is applied via hydraulic fluid in the power close line to close sliding sleeve 5. No pressure should be applied to the power open line so that minor fluid returns can occur as the piston in the sliding sleeve moves positions. After some time period the shuttle valve in sliding sleeve 5 should close, locking the sleeve in the closed position. Thereafter, the production casing is pressure tested to confirm integrity. This process is repeated for sliding sleeves 4, 3, 2, and 1 respectively.

After the formation adjacent each of sleeves 1-6 has been stimulated, the cross-linked fluids are permitted to break down thereby removing the isolation barriers. Separate RFIDs are pumped down the control line to open and allow the well to be flow tested sequentially open sleeves 1, 2, 3, 4, 5, and 6 in order, while applying pressure to power open line and holding no back pressure on the power close line. The production casing and associated sleeves and lines can then be retrieved from the well, after circulating fluid down the production casing and up annulus. Thereafter, the well completion operations are continued.

Although the fracturing process of the present invention has been depicted in FIG. 5 and described above as performed with a signal device 112 conveyed through control line 114 to selectively, hydraulically operate the sliding sleeves in tools 530 A-F in a manner as described above with reference to FIG. 2, the fracturing process of the present invention can be practiced with other control means. For example, the control signal device 112 and control line 114 depicted in FIGS. 2 and 5 and described above in relation thereto can be eliminated and the systems of FIGS. 2 and 5 can be operated by sending signals, such as acoustic or electromagnetic signals, to reader device(s) 120A, 120B and 120N via the earth, fluid contained in well 502, or casing 504 or 506 or other tubulars positioned in the well from a suitable source 550 located at the surface of the earth 503. Use of seismic monitoring equipment can be useful in monitoring fracture propagation in real time operations.

Although the antennae of the present invention has been illustrated in FIGS. 1-4 as being coiled around the control line employed in accordance with the present invention, certain signal devices, such as SAW, may not require a coiled antenna for the signal transmitted thereby to be received by the associated reader device(s). In such instances, the reader device(s) 20, 120, 220, and 320 can have an antenna that is proximate to control line 14, 114, 214, and 314, respectively. Further, in those embodiments of the present invention where the signal device can be conveyed into the well from the control line, the signal device can be equipped with suitable gauges, such as temperature and pressure, and conveyed into a subterranean formation surrounding the well. Subsequently, the signal device can be produced with formation fluid into the well and the surface of the earth where the information recorded in the signal device can be read. The systems, assemblies and processes of the present invention allow a plurality of tools in a well to be controlled via a limited number of hydraulic lines. Nonlimiting examples of tools useful in the systems, assemblies and processes of the present invention are sliding sleeves, packers, perforating guns, flow control devices, such as chokes, and cutters.

While the foregoing preferred embodiments of the invention have been described and shown, it is understood that the alternatives and modifications, such as those suggested and others, can be made thereto and fall within the scope of the invention.

I claim:

1. A process comprising;

configuring a plurality of signal devices each with a unique signal for conveyance downhole;

configuring a plurality of tools to each correspondingly receive one of the unique signals of the signal devices;

positioning the tools and a line downhole in a well penetrating a subterranean environs, said tools configured to be operated, after being positioned in the well, in response to the unique signals of the corresponding signal devices conveyed downhole;

conveying the configured signal devices downhole with fluid in the line in any first desired sequence of at least two or more of said configured tools at spaced apart locations along the well penetrating the subterranean environs;

opening, in response to the configured signal devices, sliding sleeves of the at least two or more of said configured tools by moving the sliding sleeves with the fluid in the line; and fracturing the subterranean environs using the at least two or more of said configured tools operated in the any first desired sequence at the spaced apart locations along the well penetrating the subterranean environs, said tools being used in and remaining in the well during said fracturing.

2. The process of claim 1 wherein fracturing in the any first desired sequence of the at least two or more of said configured tools comprises fracturing the subterranean environs substantially simultaneously using at least two of the at least two or more of said configured tools from at least two of said spaced apart locations.

3. The process of claim 1 wherein the subterranean environs is one subterranean formation.

4. The process of claim 1 wherein fracturing in the any first desired sequence of the at least two or more of said configured tools comprises fracturing the subterranean environs using a second of the at least two or more of said configured tools in the any first desired sequence at a second of said spaced apart locations after fracturing the subterranean environs using two first of the at least two or more of said configured tools in the any first desired sequence at two first of said spaced apart locations that are adjacent to the second of said spaced apart locations, said second of said spaced apart locations being farther from the surface of the earth along the well than at least one of said two first of said spaced apart locations.

5. The process of claim 4 wherein the subterranean environs is one subterranean formation.

6. The process of claim 1 wherein the step of fracturing comprising pumping a fracturing fluid under pressure through the well bore and the opened sliding sleeve in at least one of said tools and into the subterranean environs.

7. The process of claim 6 wherein said opened sliding sleeve is opened by at least one of the signal devices conveyed within the well.

8. The process of claim 1 wherein fracturing in the any first desired sequence comprises fracturing a first portion of the subterranean environs at a first location along the well thereby creating rock stress within said first portion, wherein the well is substantially horizontal through the subterranean environs, and fracturing a second portion of said subterranean environs at a second location along the well thereby resulting in fractures in said second portion that have a geometry influenced by the rock stress present in said first portion.

9. The process of claim 8 wherein said fractures in said second portion extend farther from the well due to influence of the rock stress present in the first portion.

10. The process of claim 8 wherein said fractures in said second portion extend farther from the first portion due to influence of the rock stress present in the first portion.

11. The process of claim 8 wherein the subterranean environs is one subterranean formation.

12. The process of claim 8 further comprising:

fracturing a third portion of said subterranean environs at a third location along the well prior to said fracturing of said second portion, said fracturing of said third portion creating rock stress within said third portion that influences the geometry of said fractures in said second portion.

13. The process of claim 1 wherein fracturing in the any first desired sequence of the at least two or more of said configured tools comprises fracturing the subterranean environs using a first of the at least two or more of said configured tools at a first of said spaced apart locations after fracturing the subterranean environs using a second of the at least two or more of said configured tools at a second of said spaced apart locations which is closer to the surface of the earth along the well.

14. The process of claim 13 wherein the subterranean environs is one subterranean formation.

15. The process of claim 1 wherein the well is substantially horizontal through the subterranean environs.

16. The process of claim 1, further comprising:

opening the sliding sleeve in each of said tools in any second desired sequence of at least two or more of said configured tools during production of production fluid from the subterranean environs.

17. The process of claim 1 wherein more than one of said tools are operated by at least one of the signal devices conveyed within the well.

18. The process of claim 1 wherein configuring the signal devices with the unique signals for conveyance downhole comprises programming each of the signal device to generate at least one of the unique signals.

19. The process of claim 1 wherein configuring the tools to correspondingly receive the unique signals of the signal devices comprises configuring a reader of each tool to look for at least one of the unique signals.

20. The process of claim 1 wherein fracturing the subterranean environs using the tools operated in the any first desired sequence comprises opening the sliding sleeves of the tools for the fracturing; and closing the sliding sleeves after the fracturing in response to a preprogrammed period of time or in response to one of the signal devices conveyed downhole.

21. The process of claim 1 wherein said tools are operable in any second desired sequence of at least two or more of said configured tools after being operated in the any first desired sequence of the at least two or more of said configured tools; and wherein the process further comprises producing from the subterranean environs using the tools operated in the any second desired sequence at spaced apart locations along the well penetrating the subterranean environs.

22. The process of claim 21 wherein producing from the subterranean environs using the tools operated in the any second desired sequence comprises opening the sliding sleeve in each of the tools for the production in response to a preprogrammed period of time or in response to one of the signal devices conveyed downhole.

23. The process of claim 1, wherein the sliding sleeve is movable at least from a closed position to an opened position with the fluid in the line.

24. The process of claim 23, further comprising closing the sliding sleeves from the opened position to the closed position with the fluid in the line for each of said tools after fracturing the subterranean environs using the at least two or more of said configured tools.

25. The process of claim 24, further comprising opening the sliding sleeve in each of said tools with the fluid in the line in any second desired sequence of at least two or more of said configured tools during production of production fluid from the subterranean environs.

26. The process of claim 1, wherein positioning the tools and the line downhole in the well penetrating the subterranean environs comprises positioning the tools at the spaced apart locations in communication with the line.

27. The process of claim 26, wherein the line comprises a hydraulic line; and wherein conveying the configured signal devices downhole with the fluid in the line comprises pumping the configured signal devices through the hydraulic line with hydraulic fluid.

28. The process of claim 27, wherein opening the at least two or more of said configured tools by moving the sliding sleeves of the at least two or more of said configured tools with the fluid in the line comprises:

detecting passage of the configured signal devices in the line with the tools;

directing the fluid in the line to the sliding sleeves of the tools;

moving the sliding sleeves with the directed fluid from a closed position to an opened position relative to at least one opening in the tools.

* * * * *